United States Patent [19]

Grainger

[11] Patent Number: 4,824,143

[45] Date of Patent: Apr. 25, 1989

[54] LIPSTICK SAMPLER AND METHOD OF FABRICATION

[75] Inventor: Frederick Grainger, West Greenbrook, N.J.

[73] Assignee: Webcraft Technologies, Inc., N. Brunswick, N.J.

[21] Appl. No.: 105,790

[22] Filed: Oct. 8, 1987

[51] Int. Cl.[4] ..... G09F 5/02; B65D 73/00; B42D 5/00; A45D 40/00

[52] U.S. Cl. ..... 283/56; 281/15.1; 206/462; 132/317

[58] Field of Search ..... 283/56, 49, 34; 281/15 R; 132/79 C, 79 D; 206/538, 462, 470, 45.13, 45.15, 45.23, 45.24, 45.28, 45.31

[56] References Cited

U.S. PATENT DOCUMENTS

| | | | |
|---|---|---|---|
| 1,689,637 | 10/1928 | Mordecai | 281/15 R |
| 1,754,981 | 4/1930 | Coryell | 132/79 D |
| 2,561,400 | 7/1951 | Morrell | 132/79 D |
| 2,606,565 | 9/1952 | Sage, Sr. | 132/88.7 |
| 2,802,569 | 8/1957 | Massey | 206/462 |
| 3,970,332 | 7/1976 | Alford, Jr. | 283/56 |
| 4,125,190 | 11/1978 | Davie, Jr. et al. | 206/462 |
| 4,466,534 | 8/1984 | Dunn | 206/462 |

*Primary Examiner*—Frank T. Yost
*Assistant Examiner*—Paul M. Heyrana, Sr.
*Attorney, Agent, or Firm*—Shlesinger & Myers

[57] ABSTRACT

A cosmetic sampler comprises a first panel. A spreadable solid material overlies a portion of the first panel. A transparent panel overlies the first panel and includes a bubble portion overlying at least a portion of the material. A second panel overlies the first and transparent panels. The second panel is substantially opaque and includes a first window through which the bubble portion extends so that the underlying cosmetic material may be viewed.

29 Claims, 1 Drawing Sheet

FIG 1
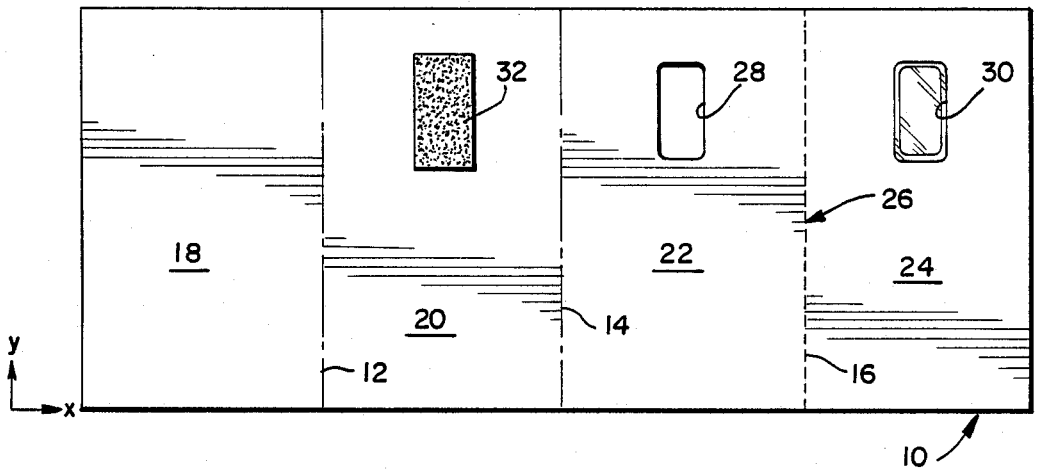
FIG 3
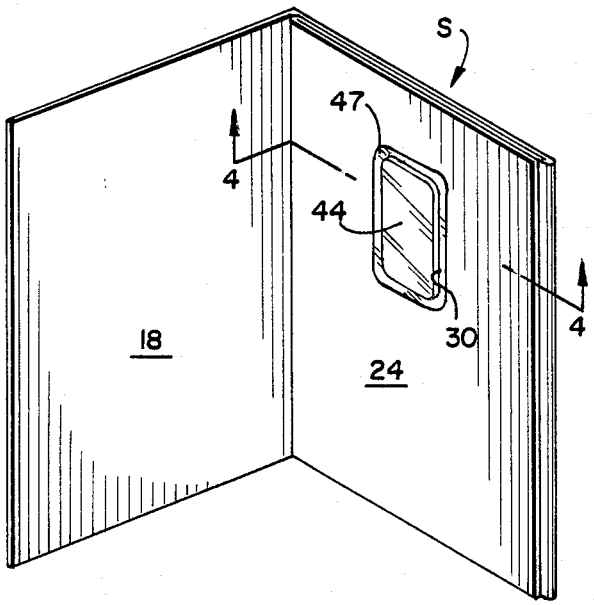
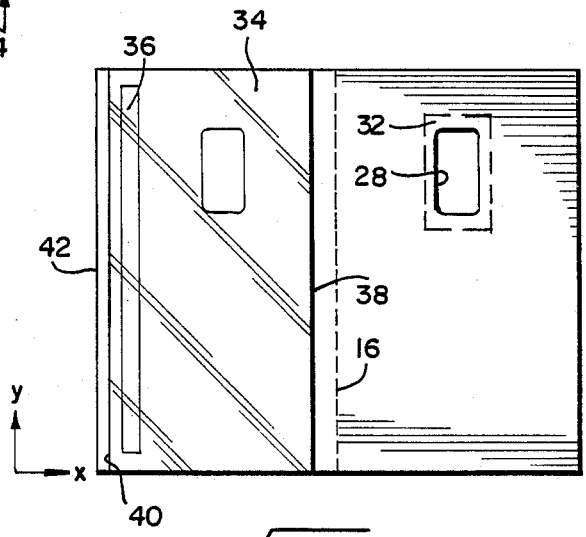
FIG 2
FIG 4
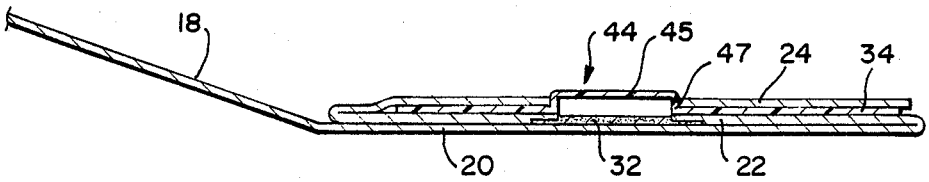

LIPSTICK SAMPLER AND METHOD OF FABRICATION

RELATED APPLICATIONS

The disclosed invention is an improvement of the invention disclosed in Application Ser. No. 917,079 entitled Advertising Sampler and Method of Manufacture filed Oct. 8, 1986 in the names of M. A. Parotta, et al, the assignee of which is the assignee of the present invention, and the disclosure of which is incorporated herein by reference.

BACKGROUND OF THE INVENTION

Lipstick is a cosmetic which is a mixture of high quality waxes, oils and fats to which a pigment or stain has been added. The mixture is a solid, although it is relatively smooth and is easily spread.

The above referenced patent application discloses a sampler for cosmetics which is relatively easy to manufacture, relatively inexpensive to manufacture and suitable for carrying one or more of a number of cosmetic compositions. I have found, however, that that sampler is not particularly well suited for use with lipstick because of the spreadable nature of lipstick, as well as the relative thickness of the lipstick carried by the sampler. The prior sampler is so thin that the lipstick frequently becomes smudged, thereby ruining the attractiveness of the sampler and leaving little or no lipstick to be sampled.

In view of the above, those skilled in the art will understand that there is a need for a relatively thin lipstick sampler which can be readily manufactured from a paper strip, at little expense and yet prevent the lipstick sample from becoming smudged or otherwise marring the appearance of the sampler. The disclosed invention is just such a lipstick sampler and one which can be manufactured in strip form and utilize the actual lipstick sample itself, rather than some artificial representation thereof. The disclosed sample is suitable for mass distribution; as through the mails, in newspapers, magazines and the like.

OBJECTS AND SUMMARY OF THE INVENTION

The primary object of the disclosed invention is a mass distribution lipstick sampler which can be made from a paper strip, which carries a sample of the lipstick itself and which has means for preventing the lipstick sample from becoming smudged or otherwise marring the sampler.

A lipstick sampler according to the invention comprises a first panel. A spreadable solid lipstick material overlies a portion of the first panel. A transparent panel overlies the first panel and has a bubble portion which overlies at least a portion of the lipstick material and is spaced therefrom to prevent contact with the lipstick material. A second panel overlies the first and transparent panels and is substantially opaque. The second panel includes a window through which the bubble portion extends so that the underlying lipstick material may be viewed.

The method of forming a sampler for lipstick materials comprises providing a strip having first and second scorelines defining first, second and third panels and the second and third panels each having a window therethrough. A spreadable lipstick composition is applied to the first panel. The second panel is folded along the first scoreline so that the second panel overlies the first panel and the second panel window exposes the underlying lipstick composition. A transparent panel is positioned in overlying relation to the second panel and includes a bubble portion which is aligned with the first window and extends therefrom in order to prevent contact with the lipstick composition exposed by the window. The third panel is folded long the second scoreline so that the third panel overlies the transparent panel. The third panel includes a second window through which the bubble extends so that the lipstick may be viewed.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a plan view of the sampler of the invention in strip form;

FIG. 2 is a plan view of the sampler of FIG. 1 after having been folded into a first position;

FIG. 3 is a perspective view of the sampler of FIG. 1 in the folded position; and, FIG. 4 is a fragmentary cross-sectional view taken along the section 4—4 of FIG. 3 and viewed in the direction of the arrows.

DESCRIPTION OF THE INVENTION

Sampler S, as best shown in FIG. 3, is manufactured from paper strip 10 of FIG. 1. Strip 10 is preferably calendared stock 70 weight paper, or has a clay coating. The strip 10 is therefore substantially opaque and has an oil impervious coating or is sufficiently thick to prevent oil from bleeding therethrough.

Scorelines 12, 14 and 16 are disposed in spaced parallel relation along strip 10 and divide strip 10 into panels 18, 20, 22 and 24. Scoreline 16 may include perforations 26 in order to permit ease of folding panel 24 into overlying relation. The panels all have a corresponding length in the y direction of FIG. 1. Panel 24, however, has a width in the x direction of FIG. 1 which is less than the uniform width of the other panels 18, 20 and 22.

First window 28 is formed in panel 22, such as by punching. Second window 30 is likewise formed in panel 24 by similar means. It can be noted in FIG. 1 that the window 30 is positioned in panel 24 at approximately the same position as the window 28 is positioned in panel 22. The window 30, however, has a length and a width which exceed the corresponding length and width of the window 28. Although the windows 28 and 30 are illustrated as being rectangular, those skilled in the art will understand that they can have any selected configuration, although it is preferred that the windows 28 and 30 have a conforming configuration. Similarly, while I have illustrated a single window in each of the panels 22 and 24, those skilled in the art will understand that the panels may have any desired numbered of windows formed therein, it merely being required that there be a corresponding number.

Lipstick composition 32 is applied to panel 20, such as through use of a print wheel or the like. The lipstick composition 32 is positioned on panel 20 at substantially the same position as the windows 28 and 30 are positioned in their respective panels 22 and 24. It can also be noted that the composition 32 has a configuration conforming to that of the windows 28 and 30. Also, the composition 32 has a length and a width which exceeds the corresponding length and width of the windows 28 and 30. We have found that the lipstick composition 32 should be relatively thick in order to permit a sufficient quantity for application to the lips. The lipstick composition 32 has a thickness almost equal to the thickness of strip 10. As noted, the strip 10 is substantially opaque and prevents the composition 32 from being viewed through the panel 20 and also from bleeding therethrough.

Transparent panel 34 is adhesively secured to panel 24 along adhesive strip 36, as best shown in FIG. 2. Transparent panel 34 has a length in the y direction substantially equal to the length of strip 10, but a width in the x direction less than that of panel 24. As illustrated in FIG. 2, panel 34 has a first side edge 38 which is spaced from scoreline 16. Second side edge 40, on the other hand, is inwardly spaced from edge 42 of panel 24.

Transparent panel 34 is, preferably, manufactured from a polymeric material which is relatively thin, preferably on the order of 0.007 inches, and lightweight. Bubble 44 extends through window 30 in panel 24 and has a shape conforming to the shape of window 30, as best illustrated in FIG. 3. It can be noted in FIG. 3 that bubble 44 has a length and a width less than the corresponding length and width of window 30 so that a transparent portion 46 extends thereabout. The bubble 44 may be formed by vacuum forming or punching with appropriately dimensioned and configured dies and extends from panel 34 on the order of 0.012 inches. Therefore, the planar surface 45 of bubble 44 is spaced from lipstick 32 and prevents lipstick 32 from being smudged. Bubble 44 has a continuous rim 47 which is sufficiently strong to withstand the crushing force as may be applied to magazines and the like in which sampler S is distributed.

Bubble 44 permits the underlying lipstick composition 32 to be viewed, while folding of panel 24 on scoreline 16 permits the lipstick composition 32 to be accessed. In this way, the recipient of sampler S can first decide whether the color of lipstick sampler 32 is attractive, and can then apply the lipstick composition 32 if so desired.

Manufacture of sampler S from strip 10 can be performed on high speed processing equipment conventional in most printing plans. The use of a strip 10, along with a strip-like panel 34, permits essentially continuous manufacture from coils of appropriate material.

Scorelines 12, 14 and 16 are formed in strip 10, as are windows 28 and 30. Lipstick composition 32 is applied to panel 20 by a print roller or the like. Panels 22 and 24 are folded about scoreline 14 so as to overlie panels 18 and 20, as best shown in FIG. 2. The lipstick composition 32 has dimensions exceeding the dimensions of window 30 so that panel 22 is releaseably secured thereto. Furthermore, the panel 22 may be adhesively secured to panel 20 to prevent separation of the panels. It can be seen in FIG. 2 that the lipstick composition 32 is framed by window 28.

Transparent panel 34 is then adhesively secured to the then exposed surface of panel 24, although those skilled in the art will appreciate that panel 34 could have been attached earlier in the manufacturing process. As such, bubble portion 44 is positioned within window 30. Because window 30 has dimensions exceeding the corresponding dimensions of bubble portion 44, the positioning of bubble portion 44 need not be very accurate, just as the application of lipstick composition 32 need not be particularly accurate with regard to window 28. The relatively large size of bubble portion 44 with regard to window 28 and the relatively large size of window 30 with regard to bubble portion 44 assures general alignment with sufficient detail to permit lipstick composition 32 to be viewed through bubble portion 44, while achieving an attractive and well defined package.

Panel 24 and its adhesively secured transparent panel 34 are then folded about scoreline 16 so as to overlie window 28 and its underlying framed lipstick composition 32. Finally, panel 18 is folded about scoreline 12 so as to close sampler S. Naturally, those skilled in the art will understand that the exposed surfaces of panels 18, 24 and 22 can be printed with advertising or the like as desired.

Upon receipt of sampler S, the consumer (not shown) can view the advertising on the exposed surface of panel 18. Opening of sampler S, by unfolding panel 18 about scoreline 12, permits the lipstick composition 32 to be viewed through bubble portion 44. The consumer may then determine whether the lipstick composition 32 is pleasing and should be sampled. Should sampling be desired, then panel 24 is unfolded on scoreline 16 and the exposed lipstick composition 32 may be removed through window 28 by use of a fingertip. As noted, there is sufficient lipstick composition 32 exposed through window 28 to permit the consumer to sufficiently coat the lips in order to make the determination as to purchase. Because the lipstick composition 32 is the same as that which is sold in conventional tubes, the consumer need not fear color differences or the like.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention or the limits of the appended claims.

What I claim is:

1. A cosmetic sampler, comprising:

(a) a first panel;

(b) a spreadable solid material overlying a portion of said first panel;

(c) a transparent panel overlying said first panel and including a bubble portion overlying at least a portion of said material; and, (d) a second panel overlying said first and transparent panels, said second panel being substantially opaque and including a first window through which said bubble portion extends so that said material may be viewed.

2. The sampler of claim 1, wherein:

(a) said first panel including means for preventing said material from bleeding therethrough.

3. The sampler of claim 2, wherein:

(a) said first panel comprised of paper for preventing said material from being viewed therethrough.

4. The sampler of claim 2, wherein:

(a) said transparent panel secured to said second panel; and,
(b) said transparent panel comprised of a polymeric material.

5. The sampler of claim 1, wherein:
(a) said first and second panels being integral; and,
(b) said first and second panels comprised of paper.

6. The sampler of claim 1, further comprising:
(a) a third substantially opaque panel overlying said first panel and underlying said transparent panel, said third panel including a second window overlying said material and aligned with said first window.

7. The sampler of claim 6, wherein:
(a) said second window conforming to and having dimensions smaller than the corresponding dimensions of said first window.

8. The sampler of claim 6, wherein:
(a) said bubble portion conforming to and having dimensions less than the corresponding dimensions of said first window so that a transparent flange extends thereabout.

9. The sampler of claim 8, wherein:
(a) said bubble portion conforming to and having dimensions exceeding the corresponding dimensions of said second window.

10. The sampler of claim 6, wherein:
(a) said first, second and third panels being integral and comprising a strip;
(b) first and second scorelines being formed in said strip for defining said panels and for permitting said panels to be folded into overlying relation;
(c) said third panel is disposed between said first and second panels;
(d) said first scoreline is disposed between said first and third panels;
(e) said second scoreline is disposed between second and third panels; and
(f) said transparent panel being secured to said second panel.

11. The sampler of claim 10, further comprising:
(a) a fourth panel integral with said first panel; and,
(b) a third scoreline separating said first and fourth panels for permitting said fourth panel to be folded over said second panel.

12. The sampler of claim 1, wherein:
(a) said bubble portion extending from said transparent panel a distance substantially equal to twice the thickness of said transparent panel.

13. A cosmetic sampler, comprising:
(a) a strip of substantially opaque material;
(b) first and second scorelines disposed in said strip and defining first, second and third panels;
(c) said first scoreline being disposed between said first and second panels;
(d) said second scoreline being disposed between said second and third panels;
(e) a spreadable solid cosmetic composition overlying a portion of said first panel;
(f) said second panel folded along said first scoreline and overlying said first panel, said second panel including a first window overlying at least a portion of said composition;
(g) a transparent panel overlying said second panel and including a bubble portion overlying and extending from said first window; and,
(h) said third panel folded along said second scoreline and overlying said transparent panel, said third panel including a second window through which said bubble portion extends so that said composition may be viewed.

14. The sampler of claim 13, wherein:
(a) said transparent panel being secured to said third panel.

15. The sampler of claim 13, wherein:
(a) said first, second and third panels being generally rectangular; and,
(b) said first and second panels being substantially uniform in dimension.

16. The sampler of claim 13, wherein:
(a) said bubble portion conforming to and having dimensions exceeding the corresponding dimensions of said first window;
(b) said second window conforming to and having dimensions exceeding the corresponding dimensions of said bubble portion; and,
(c) said bubble portion including a rim for preventing said bubble portion from being crushed.

17. The sampler of claim 16, wherein:
(a) said strip comprised of paper and incorporating means for preventing said composition from bleeding therethrough;
(b) said transparent panel comprised of a polymeric material; and,
(c) said composition including lipstick.

18. A sampler for spreadable cosmetics, comprising:
(a) a first panel;
(b) a transparent panel overlying said first panel and including a bubble portion; and,
(c) a second panel overlying said transparent panel, said second panel being substantially opaque and having a first window therein through which said bubble portion extends so that a material applied to said first panel in alignment with said first window may be viewed.

19. The sampler of claim 18, further comprising:
(a) a third panel overlying said first panel and underlying said transparent panel, said third panel being substantially opaque and including a second window aligned with said bubble.

20. The sampler of claim 18, wherein:
(a) said transparent panel being secured to said second panel; and,
(b) said first and second panels being integral and comprised of paper.

21. The sampler of claim 19, wherein:
(a) said bubble conforming to and having dimensions exceeding the corresponding dimensions of said scond window; and,
(b) said first window conforming to and having dimensions exceeding the corresponding dimensions of said bubble.

22. A sampler for spreadable cosmetics, comprising:
(a) a paper strip;
(b) first and second spaced scorelines in said strip defining first, second and third panels;
(c) said first scoreline being disposed between said first and second panels;
(d) said second scoreline being disposed between said second and third panels;
(e) said second panel folded along said first scoreline and overlying said first panel, said second panel including a first window through which a portion of said first panel is exposed;

(f) a transparent panel overlying said second panel and including a bubble portion extending therefrom in alignment with said first window; and, (g) said third panel folded along said second scoreline and overlying said transparent panel, said third panel including a window through which said bubble extends.

23. The sampler of claim 22, wherein:

(a) said bubble portion conforming to and having dimensions exceeding the corresponding dimensions of said first window; and, (b) said second window conforming to and having dimensions exceeding the corresponding dimensions of said bubble portion.

24. The sampler of claim 22, wherein:

(a) said transparent panel being secured to said third panel.

25. The method of forming a sampler for spreadable cosmetics, comprising the steps of:

(a) providing a strip having first and second scorelines defining first, second and third panels and said second and third panels each having a window therethrough;

(b) applying a spreadable cosmetic composition to said first panel;

(c) folding said second panel along said first scoreline so that said second panel overlies said first panel and said second panel window exposes said underlying cosmetic composition;

(d) positioning a transparent panel in overlying relation to said second panel and said transparent panel including a bubble portion aligned with said first window and extending therefrom; and, (e) folding said third panel along said second scoreline so that said third panel overlies said transparent panel and said third panel including a second window through which said bubble portion extends so that said composition may be viewed.

26. The method of claim 24, including the step of:

(a) securing said transparent panel to said third panel.

27. The method of forming a sampler for spreadable cosmetics, comprising the steps of:

(a) providing a first substantially opaque panel;

(b) applying a spreadable cosmetic composition to said first panel;

(c) positioning a transparent panel in overlying relation to said first panel, said transparent panel including a bubble portion aligned with said composition and extending away therefrom; and, (d) positioning a second substantially opaque panel in overlying relation to said transparent panel, said second panel including a first window through which said bubble portion extends so that said underlying composition is visible therethrough.

28. The method of claim 27, including the step of:

(a) securing said transparent panel to said second panel.

29. The method of claim 28, including the step of:

(a) positioning a third substantially opaque panel between said first and transparent panels, said third panel including a second window aligned with said composition.

* * * * *